US006036789A

United States Patent [19]

Weibel

[11] Patent Number: 6,036,789

[45] Date of Patent: Mar. 14, 2000

[54] AQUEOUS CLEANING COMPOSITIONS CONTAINING 2-ETHYLHEXYL SULFATE AND OPTIONALLY MYRISTYLDIMETHYLAMINE OXIDE FOR REMOVING SOAP SCUM

[75] Inventor: A. Thomas Weibel, Cranbury, N.J.

[73] Assignee: Reckitt & Colman Inc., Wayne, N.J.

[21] Appl. No.: 09/243,966

[22] Filed: Feb. 2, 1999

[30] Foreign Application Priority Data

Feb. 25, 1998 [GB] United Kingdom ..... 9803814

[51] Int. Cl.[7] ..... B08B 3/04; C11D 1/14; C11D 1/75; C11D 1/83; C11D 3/395

[52] U.S. Cl. ..... 134/42; 510/191; 510/238; 510/272; 510/370; 510/380; 510/427; 510/433; 510/503; 252/187.26

[58] Field of Search ..... 510/191, 238, 510/272, 370, 380, 427, 433, 503; 252/187.26; 134/42

[56] References Cited

U.S. PATENT DOCUMENTS

| | | | |
|---|---|---|---|
| 4,282,109 | 8/1981 | Citrone et al. | 510/373 |
| 4,337,163 | 6/1982 | Schilp | 252/187.24 |
| 4,585,570 | 4/1986 | Nelson | 252/187.25 |
| 4,588,514 | 5/1986 | Jones et al. | 252/187.25 |
| 4,772,414 | 9/1988 | Marzec et al. | 510/369 |
| 4,789,496 | 12/1988 | Cahall et al. | 510/338 |
| 4,800,036 | 1/1989 | Rose et al. | 310/370 |
| 5,185,096 | 2/1993 | Ahmed | 510/221 |
| 5,462,689 | 10/1995 | Choy et al. | 510/373 |
| 5,624,891 | 4/1997 | Smialowicz et al. | 510/195 |
| 5,693,601 | 12/1997 | Iakovides | 510/191 |
| 5,703,036 | 12/1997 | Iakovides | 510/427 |

FOREIGN PATENT DOCUMENTS

| | | | |
|---|---|---|---|
| 0574858 | 12/1993 | European Pat. Off. | C23G 1/14 |
| 3527910 | 8/1985 | Germany | D06L 3/06 |
| WO97/09407 | 3/1977 | WIPO | C11D 3/20 |
| WO94/24259 | 10/1994 | WIPO | C11D 3/395 |
| WO95/03383 | 2/1995 | WIPO | C11D 1/75 |
| WO95/08610 | 3/1995 | WIPO | C11D 1/14 |
| WO95/08611 | 3/1995 | WIPO | C11D 1/14 |
| WO97/09412 | 3/1997 | WIPO | C11D 7/12 |

*Primary Examiner*—Yogendra Gupta
*Assistant Examiner*—Gregory R. Delcotto
*Attorney, Agent, or Firm*—Fish & Richardson P.C.

[57] ABSTRACT

Dilute aqueous compositions for removing soap scum consisting essentially of sodium carbonate, hypochlorite bleach, alkali metal hydroxide and a surfactant system consisting either of sodium 2-ethylhexyl sulfate and myristyldimethylamine oxide or of sodium 2-ethylhexyl sulfate alone.

4 Claims, No Drawings

AQUEOUS CLEANING COMPOSITIONS CONTAINING 2-ETHYLHEXYL SULFATE AND OPTIONALLY MYRISTYLDIMETHYLAMINE OXIDE FOR REMOVING SOAP SCUM

BACKGROUND OF THE INVENTION

1. Field of the Invention

This invention relates to cleaning compositions suitable for use in cleaning hard surfaces in a household environment, in particular, the cleaning of tile surfaces. More particularly, the cleaning compositions are suitable for use in removing lime soap soils commonly referred to as "soap scum".

Although there are many known cleaning compositions for hard surfaces, alternative formulations are desirable. There is a particular need for cleaning compositions directed to removing soap scum build-up from such surfaces.

Soap scum build-up is a problem encountered particularly in bathrooms and kitchens with ceramic tile. Typically, removal of the scum requires a rubbing or wiping of the surface after treatment with the cleaning composition. Penetrating beneath the scum and removing the build-up is the most desired method of removal. Formulating a cleaning composition for such penetrating action is difficult, however, because many compositions leave an undesirable smearing or streaking effect on the tile after cleaning.

2. Prior Art

A number of compositions have been suggested for possible use in removing soap scum. Many of these require high concentrations of active ingredients and/or solvent systems containing multiple ingredients. Others require the use of ingredients which, as noted above, leave behind a solid residue, thus necessitating a rinsing step. A dilute aqueous solution which provides for easy removal of soap scum would be advantageous.

U.S. Pat. No. 4,501,680 discloses a liquid detergent composition for cleaning ceramic tiles to remove soap scum, without eroding the grout between such tiles. The disclosed formulations include partially neutralized glutaric and phosphoric acids and, as a detergent, a condensation product of ethylene oxide and linear alcohols having from 8 to 20 carbon atoms.

U.S. Pat. No. 4,581,161 discloses a hard surface cleaner with possible application to removal of soap scum. The composition is also an acidic composition, having at least one $C_5$–$C_7$ dicarboxylic acid and an organic solvent which is preferably an alkylene or polyalkylene glycol.

U.S. Pat. No. 4,587,030 is directed to a foamable cleaning composition useful for removal of soap scum and other household soils. It contains an acidic component comprising a mixture of a weak organic acid and a weak inorganic acid, an amine oxide surfactant, and a co-solvent to reduce surface tension and maintain the composition in a stable mixture.

U.S. Pat. No. 4,960,533 discloses a silicone-based hard surface cleaner suitable for removing soap scum. In addition to two required silicone components, the composition contains glutaric acid.

U.S. Pat. No. 5,439,609 discloses a composition particularly effective for removing soap scum which also imparts residual protection to the cleaned tile. The composition comprises a siloxane block polymer, an ethoxylate-based surfactant, solvents and chelating agents.

International Patent Publication No. WO97/09407 discloses dilute hard surface cleaners effective to remove soap scum. The cleaners comprise a carboxylic acid, a detersive surfactant and, unless the detersive surfactant is a tertiary amine oxide in which the longest alkyl group has from 6 to 12 carbon atoms, an organic solvent which causes the composition to form a clear mixture. As in most of the prior art discussed above, this cleaning composition is in the acid pH range.

International Patent Publication No. WO97/09412 discloses a cleaning composition suitable for removing soap scum. The compositions comprise a detersive surfactant and, unless the surfactant is a tertiary amine oxide in which the longest alkyl group has from 6 to 12 carbon atoms, also an organic solvent which causes the composition to form a clear mixture. In a preferred embodiment, the composition contains bleach.

Many of the prior art compositions are effective in removing soap scum and some of them are also effective in controlling mold and mildew, which often accompany soap scum. However, these compositions generally contain high amounts of active ingredient and/or require the use of special solvents and, as a result, they are relatively expensive to produce. It would be advantageous to develop a hard surface cleaner which would be particularly effective in removing soap scum and which contains low levels of active ingredients.

SUMMARY OF THE INVENTION

This invention provides a dilute aqueous hard surface cleaning composition, which is effective in removing soap scum and also mold and mildew. The composition consists essentially of:

(1) from about 3% to about 7% of sodium carbonate, (2) from about 0.2% to about 1% of an alkali metal hydroxide, (3) from about 1.0% to about 4.0% of sodium hypochlorite, (4) from about 0.5% to about 1.5% of sodium 2-ethylhexyl sulfate, and (5) from 0.0% to about 0.8% of myristyldimethylamine oxide.

In the foregoing formulations, all percentages are in terms of weight.

This invention also provides a method for removing soap scum from surfaces, particularly tile samples, by applying a composition consisting essentially of:

(1) from about 3% to about 7% of sodium carbonate, (2) from about 0.2% to about 1% of an alkali metal hydroxide, (3) from about 1.0% to about 4.0% of sodium hypochlorite, (4) from about 0.5% to about 1.5% of sodium 2-ethylhexyl sulfate, and (5) from 0.0% to about 0.8% of myristyldimethylamine oxide.

DETAILED DISCLOSURE

In the cleaning compositions of this invention, the amounts of the various constituents must be closely controlled in order to attain effective removal of soap scum while, at the same time, meeting the desired criteria of low-cost ingredients and a high level of dilution. All of the ingredients contained in these compositions are known as possible ingredients for hard surface cleaning compositions, but it has been surprisingly found that dilute aqueous compositions comprising these ingredients in these precise amounts are extremely effective in removing soap scum while, at the same time, minimizing residues which would require a rinsing step. The fact that the subject compositions contain from about 86% to about 95% of water and that no additional solvent is required makes them economically attractive.

A hypochlorite bleach is an important constituent of the subject compositions. Bleach is a well-known component of hard surface cleaners and is particularly effective in removing soap scum, as well as in controlling mold and mildew, substances which are often associated with soap scum. Although other hypochlorite bleaches such as, for example, potassium hypochlorite, can be used to remove mold, mildew and soap scum, the compositions of this invention require, largely for economic purposes, that the bleach be sodium hypochlorite. It is recognized that sodium hypochlorite bleach formulations of the type sold for commodity purposes often contain significant amounts of chloride salts. The use of such compositions as a source of sodium hypochlorite is contemplated within the purview of this invention, thereby avoiding the need to use "high purity" NaOCl. In the compositions of this invention, sodium hypochlorite is present in a range of from about 1.0 to about 4.0 weight percent, preferably from 2.0 to 3.0 weight percent and, more preferably, an amount of about 2.5 weight percent.

Sodium carbonate is a well-known builder used in cleaning compositions and is present in an amount of from about 3.0 to about 7.0 weight percent, preferably from 4.0 to 6.0 weight percent, of the composition.

The compositions of this invention are alkaline and, in order to ensure the appropriate alkalinity, from about 0.2% to about 1% of an alkali metal hydroxide should be included. Preferably, the alkali metal hydroxide is sodium hydroxide and this is desirably present in an amounts of from 0.4 to 1.0%, preferably about 0.6 weight percent.

A feature of this invention is a surfactant system consisting of either sodium 2-ethylhexyl sulfate and myristyldimethylamine oxide, or of sodium 2-ethylhexyl sulfate alone.

Octyl sulfates, particularly n-octyl sulfate, are known ingredients in hard surface cleaning compositions and can be used in compositions of this invention. However, it has been found that if the alkyl sulfate ingredient must be specifically sodium 2-ethylhexyl sulfate, a superior scum removing composition is attained. Without wishing to be bound by any theory, the superior effectiveness of the 2-ethylhexyl isomer is believed to be due to its greater stability in hypochlorite-containing solutions. The sodium 2-ethylhexyl sulfate must be present in an amount of from about 0.5% to about 1.5% of the entire aqueous cleaning composition, desirably between 0.8 and 1.4%, and preferably in an amount of about 1%.

The myristyldimethylamine oxide component has the formula

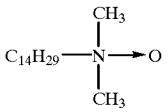

This optional component can be present in an amount of up to about 0.8 weight percent of the aqueous cleaning composition. Desirably, the myristyldimethylamine oxide is present in an amount of from 0.2% to 0.8%, preferably about 0.4%.

In addition to the foregoing essential ingredients, the compositions of this invention preferably include one or more bleach-stable fragrance components and one or more bleach-stable colorants. Preferably, the fragrance component will be relatively more volatile than the components of these compositions which are responsible for bleach odors.

The compositions of this invention can be prepared by admixing the above-described ingredients together in the appropriate concentrations by any conventional means normally used to prepare dilute aqueous compositions.

This invention will be understood by reference to the following examples which are here included for illustrative purposes only and are not intended as limitations.

EXAMPLES 1–5 AND COMPARATIVE EXAMPLE

Five compositions according to this invention and one comparative example were prepared by admixing the various active ingredients in water. The compositions had the following constituents:

TABLE I

| | Ex. 1 wt % | Ex. 2 wt % | Ex. 3 wt % | Ex. 4 wt % | Ex. 5 wt % | Comp. Ex. wt % |
|---|---|---|---|---|---|---|
| Sodium hydroxide | 0.6 | 0.6 | 0.6 | 0.6 | 0.6 | 0.6 |
| Sodium carbonate | 4.0 | 5.1 | 5.25 | 5.25 | 5.25 | 5.25 |
| Sodium hypochlorite | 2.5 | 2.5 | 2.5 | 2.5 | 2.5 | 2.5 |
| Sodium 2-ethylhexyl sulfate(1) | 1.0 | 0.8 | 1.0 | 0.8 | 0.8 | |
| Sodium hexyldiphenylether disulfonate(2) | | | | | | 0.8 |
| Myristyldimethylamine oxide(3) | 0.5 | 0.4 | | 0.2 | 0.4 | 0.2 |
| Fragrance | | 0.1 | 0.1 | 0.1 | 0.1 | 0.1 |
| Water | q.s. to 100% | q.s. to 100% | q.s. to 100% | q.s. to 100% | q.s. to 100% | q.s. to 100% |

(1)Rhodapon BOS, Rhône Poulenc
(2)Dowfax C6L, Dow
(3)Ammonyx MO, Stepan

EXAMPLE 6

Soap scum tests on tiles were conducted for the compositions of Examples 2, 3, 4 and the comparative example. The tests were conducted according to a modification of the general procedure set forth in CSMA Designation DCC-16, "Scrubber Test for Measuring the Removal of Lime Soap", published in *CSMA Detergents Division Test Methods Compendium,* pp. I-51–I-55 (3d ed. 1995), pertinent portions of which are hereby incorporated by reference.

Materials:

1. Substrate samples: standard black ceramic tile, about 10.8 $cm^2$. Use tiles that meet ANSI standard A371.1.
2. Cleaning media
   (a) Cellulose sponge.
3. Soil Components
   (a) Stearic acid based bar soap.
   (b) Shampoo: a simple, moderate-cleaning type containing alkyl ethoxysulfate is recommended. Those containing conditioning or treatment additives should be avoided.
   (c) Ball or bandy black clay.
   (d) Artificial sebum (keep refrigerated).
   (e) Hard water: deionized water with 2:1 calcium:magnesium, added to give 20,000 ppm total hardness as $CaCO_3$.

(f) Hydrochloric acid (0.1N).
(g) Acetone: HPLC grade or similar.
(h) Whatman #Q1 filter paper or equivalent.
(i) Paper towels.

Apparatus:

1. Scrubbing equipment: Gardner Neotec or equivalent.
2. Scrubbing medium holder to fit tester, weighted to 454±25 gm total.
3. Substrate holder: acrylic panel cut to fit the scrubber tray; panel has a 10.8 $cm^2$ hole in the centre to fit tile.
4. Three blade propeller mixer or other suitable mixer.
5. Suction filtration flask fitted with Buchner funnel.
6. Laboratory oven capable of maintaining 45° C.
7. Air-driven artist's "brush".
8. Laboratory oven capable of maintaining 205° C.
9. Kitchen spatula.
10. Homogenizer or other suitable high-shear mixer.

Procedures:

Day 1: Soil/Substrate Preparation

Step 1A: Parent Soil Recipe

| | |
|---|---|
| Bar scap | 3.90% w/w |
| Shampoo | 0.35 |
| Clay | 0.06 |
| Artificial sebum | 0.15 |
| Hard water | 95.54 |

1. Shave bar soap into a suitable beaker.
2. Add the remainder of the soil components, in the above order, and stir with three-blade propeller mixer.
3. Warm the recipe to 45–50° C. and mix until a smooth, lump-free suspension is achieved. This should require about two hours with moderate agitation.
4. Filter the suspension through a Buchner funnel fitted with Whatman #1 filter paper or equivalent.
5. Resuspend the filtrate in clean, deionized water, using the same amount of water used to make the soil, and filter again.
6. Uniformly dry the filtrate cake overnight at 45° C.
7. Pulverize the now-dry cake and store it dry in a closed container.

Step 1B: Substrate Preparation

1. Clean ceramic tiles with a commercial light duty liquid dishwashing product.
2. Rinse completely with clean water.
3. Dry overnight in a 45° C. oven with the face of each tile facing the oven shelf.

Day 2: Soil Preparation/Application

Step 2: Reconstituted Soil Recipe

| | |
|---|---|
| Parent Soil (Step 1A) | 4.50% w/w |
| Hard water | 9.00 |
| Hydrochloric acid (0.1N) | 0.77 |
| Acetone | 85.73 |

1. Combine the above ingredients in a suitable beaker. Add hard water to the acetone, followed by the soil. Mix until uniform, then add the acid.
2. Homogenize the suspension until color turns from white to grey (about 20–30 minutes); the beaker should be covered as much as possible to avoid excessive solvent loss.
3. Load an appropriate amount of soil into the artist's airbrush; swirl the soil to ensure soil uniformity while leading. The airbrush should be set to an air pressure of 40 psi.

Step 3: Soil Application

1. The required number of clean, dry tiles may be placed into rows and columns in preparation for soil application.
2. Spray a visually uniform amount (0.10–0.15 g) of soil onto the tiles. Maintain a uniform soil suspension during application by continuous brush motion and/or swirling of suspension.
3. Allow the tiles to air dry (about 30 minutes).
4. Preheat the laboratory oven to approximately 205° C. Place the tiles in the oven for 30 minutes to melt the soil Remove tiles with a kitchen spatula.
5. Cool tiles overnight before testing.

Step 4: Cleaning Simulation

1. The cleaning medium is tared, dampened uniformly with water and squeezed until all but 17.5±0.5gm water remains in the sponge. It is then installed into the scrubber head.
2. Approximately 2 grams of test product is sprayed from an appropriate spray bottle onto the soiled area of one tile. Allow the product to stand 30 seconds on the soil.
3. Allow the scrubber to pass across the tile twelve times (6 cycles).
4. Rinse the tile with tap water and blow dry with an air stream to eliminate water spots.

Step 5: Cleaning Evaluation

Done by a reflectometer. The percent cleaning efficiency of the test products is calculated using the following equation:

$$\%\ \text{Cleaning Efficiency} = \frac{RC - RS}{RO - RS} \times 100$$

where:

RC is reflectance of the cleaned tile

RO is reflectance of original (unsoiled) tile

RS is reflectance of soiled tile

A minimum of four RC readings for each test product per tile is done.

Further details are shown in the CSMA publication referred to above.

The results of these tests were as follows:

TABLE II

| | Ex. 2 | Ex. 3 | Ex. 4 | Comp. Ex. |
|---|---|---|---|---|
| Number of tiles | 4 | 4 | 4 | 4 |
| % clean | 57.5 | 71.1 | 57.9 | 35.9 |
| Std. deviatian | 18.1 | 15 | 18.2 | 11.4 |

These data show the superiority of the composition of this invention over a comparative composition using a surfactant commonly used in other hard surface cleaners.

What is claimed is:

1. An aqueous cleaning composition consisting essentially of:

(a) from about 3% to about 7% of sodium carbonate;

(b) from about 0.2% to about 1% of an alkali metal hydroxide;

(c) from about 1.0% to about 4.0% of sodium hypochlorite;

(d) from about 0.5% to about 1.5% of sodium 2-ethylhexyl sulfate;

(e) from 0.2% to about 0.8% of myristyldimethylamine oxide, all percentages being by weight.

2. A composition according to claim 1 in which the alkali metal hydroxide is sodium hydroxide.

3. A composition according to claim 1 in which:

(a) the sodium carbonate is present in an amount of from 4% to 6%;

(b) the alkali metal hydroxide is present in an amount of about 0.6%;

(c) the sodium hypochlorite is present in an amount of about 2.5%;

(d) the sodium 2-ethylhexyl sulfate is present in an amount of about 1.0%; and (e) the myristyldimethylamine oxide is present in an amount of about 0.4%.

4. A method for removing soap scum from a surface which comprises applying to said surface an aqueous composition consisting essentially of:

(a) from about 3% to about 7% of sodium carbonate;

(b) from about 0.2% to about 1% of an alkali metal hydroxide;

(c) from about 1.0% to about 4.0% of sodium hypochlorite;

(d) from about 0.5% to about 1.5% of sodium 2-ethylhexyl sulfate; and (e) from 0.2% to about 0.8% of myristyldimethylamine oxide, all percentages being by weight.

* * * * *